US010403979B2

(12) United States Patent
Ryu et al.

(10) Patent No.: US 10,403,979 B2
(45) Date of Patent: Sep. 3, 2019

(54) ANTENNA APPARATUS AND ELECTRONIC DEVICE INCLUDING THE SAME

(71) Applicant: WITS Co., Ltd., Yongin-si, Gyeonggi-do (KR)

(72) Inventors: Seung Hun Ryu, Suwon-si (KR); Jeong Ki Ryoo, Suwon-si (KR); Ju Hyoung Park, Suwon-si (KR); Jong Lae Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 90 days.

(21) Appl. No.: 15/067,471

(22) Filed: Mar. 11, 2016

(65) Prior Publication Data

US 2016/0268686 A1 Sep. 15, 2016

(30) Foreign Application Priority Data

Mar. 13, 2015 (KR) ..... 10-2015-0034840
Jul. 31, 2015 (KR) ..... 10-2015-0109114
Nov. 2, 2015 (KR) ..... 10-2015-0153117

(51) Int. Cl.
*H01Q 7/00* (2006.01)
*H01Q 21/28* (2006.01)
*H01Q 21/24* (2006.01)

(52) U.S. Cl.
CPC ..... *H01Q 7/00* (2013.01); *H01Q 21/24* (2013.01); *H01Q 21/28* (2013.01)

(58) Field of Classification Search
CPC ..... H01Q 7/00; H01Q 21/24; H01Q 21/28; H01Q 7/06; H01Q 7/08; H01Q 1/2208; H01Q 1/20; H01Q 1/2216; H01Q 1/2225
(Continued)

(56) References Cited

U.S. PATENT DOCUMENTS 6,195,559 B1 * 2/2001 Rapeli ..... H01Q 1/242 342/359
8,552,827 B2 10/2013 Kudo et al.
(Continued)

FOREIGN PATENT DOCUMENTS

CN 101501931 A 8/2009
CN 101536344 A 9/2009
(Continued)

OTHER PUBLICATIONS

Korean Office Action dated Jul. 28, 2016 in counterpart Korean Application No. 10-2015-0153117 (5 pages in English; 5 pages in Korean).
(Continued)

*Primary Examiner* — Daniel Munoz
*Assistant Examiner* — Bamidele A Jegede
(74) *Attorney, Agent, or Firm* — NSIP Law

(57) ABSTRACT

An antenna apparatus includes a first substrate, and a conductor pattern disposed on a surface of the first substrate and forming magnetic flux in a normal direction with respect to the surface of the first substrate. The antenna apparatus also includes a second substrate spaced apart from the first substrate, and a member disposed on the second substrate. The antenna apparatus further includes a coil wound around the member, and a current feeder configured to provide a first current to the conductor pattern and a second current to the coil.

34 Claims, 11 Drawing Sheets

(58) Field of Classification Search
USPC ..... 343/787, 788
See application file for complete search history.

(56) References Cited

U.S. PATENT DOCUMENTS

| | | | | |
|---|---|---|---|---|
| 8,698,685 | B2 | 4/2014 | Ito et al. | |
| 2002/0024429 | A1* | 2/2002 | Kamlah | B60R 25/246 340/426.1 |
| 2003/0090434 | A1* | 5/2003 | Masudaya | H01Q 1/3241 343/867 |
| 2007/0247387 | A1* | 10/2007 | Kubo | H01Q 7/08 343/787 |
| 2010/0026439 | A1* | 2/2010 | Qing | H01Q 7/00 336/200 |
| 2010/0321267 | A1* | 12/2010 | Ito | H01Q 7/08 343/788 |
| 2012/0007787 | A1* | 1/2012 | Schantz | G01S 5/14 343/788 |
| 2012/0176215 | A1* | 7/2012 | Kudo | H01F 27/34 336/221 |
| 2012/0295552 | A1* | 11/2012 | Senoo | A63B 24/0021 455/73 |
| 2013/0181876 | A1* | 7/2013 | Miura | G06K 7/10316 343/788 |
| 2014/0035793 | A1* | 2/2014 | Kato | H01Q 1/243 343/867 |
| 2014/0159848 | A1* | 6/2014 | Konanur | H01F 38/14 336/180 |
| 2014/0176382 | A1* | 6/2014 | Nakano | H01Q 1/243 343/788 |
| 2014/0198011 | A1* | 7/2014 | Tsubaki | H01Q 7/06 343/867 |
| 2014/0203976 | A1* | 7/2014 | Yosui | H01Q 7/08 343/702 |

FOREIGN PATENT DOCUMENTS

| | | | |
|---|---|---|---|
| CN | 103503234 | A | 1/2014 |
| CN | 104218321 | A | 12/2014 |
| GB | 2505577 | A | 5/2014 |
| JP | 2010-219652 | A | 9/2010 |
| JP | 2011-504338 | A | 2/2011 |
| JP | 2011-142431 | A | 7/2011 |
| JP | 2014-64267 | A | 4/2014 |
| JP | 2015-130566 | A | 7/2015 |
| KR | 10-2010-0033163 | A | 3/2010 |
| KR | 10-2013-0018933 | A | 2/2013 |
| KR | 10-1255485 | B1 | 4/2013 |
| KR | 10-2015-0010063 | A | 1/2015 |
| WO | WO 2008/016327 | A1 | 2/2008 |
| WO | WO 2009/064443 | A1 | 5/2009 |

OTHER PUBLICATIONS

Chinese Office Action dated Apr. 18, 2018 in Corresponding Chinese Patent Application No. 201610143726.X (40 pages in English, 19 pages in Chinese).

* cited by examiner

ANTENNA APPARATUS AND ELECTRONIC DEVICE INCLUDING THE SAME

CROSS-REFERENCE TO RELATED APPLICATION

This application claims the priority and benefit under 35 USC 119(a) of Korean Patent Application No. 10-2015-0034840 filed on Mar. 13, 2015, 10-2015-0109114 filed on Jul. 31, 2015 and 10-2015-0153117, filed on Nov. 2, 2015, with the Korean Intellectual Property Office, the disclosure of which is incorporated herein by reference.

BACKGROUND

1. Field

The following description relates to an antenna apparatus and an electronic device including the same.

2. Description of Related Art

Recently, near field communications (NFC), magnetic secure transmission (MST), wireless power transfer (WPT), and radio frequency identification (RFID) communications using magnetic flux, have been widely applied to portable terminals such as smartphones, portable media players (PMPs), and navigation devices.

Portable terminals, to which communications using magnetic flux are applied, enable use of wireless services including data exchanges between portable terminals, making a variety of reservations, personal authentications, and other uses.

In a case in which a communications target is present within a region in which magnetic flux is formed by the portable terminal, communications are effectively performed. Therefore, as a size of a magnetic flux field is increased, communications are more smoothly performed, and user convenience of portable terminals is increased.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an embodiment, there is provided an antenna apparatus, including: a first substrate; a conductor pattern disposed on a surface of the first substrate and forming magnetic flux in a normal direction with respect to the surface of the first substrate; a second substrate spaced apart from the first substrate; a member disposed on the second substrate; a coil wound around the member; and a current feeder configured to provide a first current to the conductor pattern and a second current to the coil.

The member may include: a magnetic body including a magnetic material and having the coil wound around the magnetic material; and a protruding part protruding from one surface of the magnetic body and providing a mounting surface for the second substrate.

A longest radius of a winding radius of the coil may be shorter than a shortest radius of a winding radius of the conductor pattern, and the coil and the conductor pattern may be spaced apart from each other by a distance, longer than a longest radius of the coil.

The antenna apparatus may also include a matching network configured to match impedance among the conductor pattern, the coil, and the current feeder.

One end of the conductor pattern may be connected to the matching network, another end of the conductor pattern may be connected to one end of the coil, and another end of the coil may be connected to the matching network.

One end of the conductor pattern may be connected to one end of the coil, the other end of the conductor pattern may be connected to another end of the coil, and the first current and the second current are independent of each other.

The conductor pattern may include: a first conductor pattern including a first winding radius; and a second conductor pattern connected to the first conductor pattern and including a second winding radius, different from the first winding radius.

The antenna apparatus may also include: a third substrate spaced apart from the first substrate; a second member disposed on the third substrate; and a second coil wound around the second member.

The antenna apparatus may also include: a second member spaced apart from the member and disposed on the second substrate; and a second coil wound around the second member, wherein a winding axis of the conductor pattern, a winding axis of the coil, and a winding axis of the second coil are perpendicular to one another.

In accordance with an embodiment, there is provided an electronic device, including: a communications circuit disposed on a substrate and configured to generate communications signals; a battery spaced apart from the substrate and configured to supply power to the communications circuit; a first antenna disposed on the battery and configured to form a first magnetic flux in one direction; a second antenna disposed on the substrate and configured to form a second magnetic flux in a direction different to the one direction; and a current feeder disposed on the substrate, configured to receive the communications signals, provide a first current corresponding to one of the communications signals to the first antenna, and provide a second current corresponding to one of the communications signals to the second antenna.

The first antenna may include loop antennas wound in different winding radii.

The second antenna may include chip antennas having different winding axis directions.

The second antenna may include first and second chip antennas disposed to be opposite to each other in relation to the first antenna.

The second antenna may include chip antennas disposed to surround the first antenna.

The electronic device may also include: a state sensor configured to sense a state between the one direction and a gravity direction, wherein the current feeder determines magnitude of the first and second currents based on the state.

The electronic device may also include: a display panel configured to display in the one direction; and a housing configured to accommodate the communications circuit, the current feeder, and the first and second antennas together with the display panel.

In accordance with another embodiment, there is provided an antenna apparatus, including: a first substrate; a conductor pattern disposed on the first substrate; a second substrate spaced apart from the first substrate; a member disposed on the second substrate; and a coil wound around the member, wherein a longest radius of a winding radius of the coil may be smaller than a shortest radius of a winding radius of the conductor pattern, and the conductor pattern and the coil are spaced apart from each other by a distance greater than the longest radius of the winding radius of the coil.

The antenna apparatus may also include: a current feeder configured to provide a first current to the conductor pattern and a second current to the coil and configured to control a magnitude, a frequency, and a phase of the first and second currents.

A magnetic flux may be formed by the coil may be unaffected by a magnetic flux formed by the conductor pattern.

A number of turns of the coil may be greater than a number of turns of the conductor pattern.

The first substrate may be adjacently disposed in a region where a magnetic flux may be formed by the conductor pattern.

The member may be adjacently disposed in a region in which a magnetic flux may be formed by the coil.

The conductor pattern may include a first conductor pattern including a first winding radius being an average of a longest radius and the shortest radius of the winding radius of the conductor pattern, and a second conductor pattern connected to the first conductor pattern, and wound to have a second winding radius, different from the first winding radius.

The first conductor pattern and the second conductor pattern each may form a magnetic flux in a different region of the first substrate.

The member may include a magnetic body including an end surface having a quadrangular shape or a rectangular parallelepiped shape, a protruding part positioned on a surface of the magnetic body, and a mounting surface configured to protrude from a surface that may be opposite to the surface on which the protruding part may be positioned.

In accordance with an embodiment, there is provided an antenna apparatus, including: a first substrate; a conductor pattern disposed on a surface of the first substrate; a first member mounted on a second substrate, spaced apart from the first substrate; a first coil wound around the first member; a second member mounted on a third substrate, spaced apart from the first and second substrates; and a second coil wound around the second member, wherein the first substrate may be disposed between the first member and the second member, and winding radii of the first coil and the second coil are smaller than a winding radius of the conductor pattern.

The antenna apparatus may further include: a current feeder configured to generate a current to the second coil to form a magnetic flux, wherein the conductor pattern and the first coil are connected to the current feeder in parallel; and a matching network configured to match impedance between the conductor pattern, the first coil, and the current feeder.

One end of the conductor pattern may be connected to one end of the first coil, and another end of the conductor pattern may be connected to another end of the first coil.

The first coil may be spaced apart from the conductor pattern by a distance greater than a winding radius of the first coil, and the second coil may be spaced apart from the conductor pattern by a distance longer than a winding radius of the second coil.

A winding axis of the conductor pattern, a winding axis of the first coil, and a winding axis of the second coil may be perpendicular to one another.

The first member and the second member may be disposed on a plane perpendicular to a surface direction of the first substrate to surround the first substrate.

The first member may have a rod shape elongated in a direction of a winding axis of the coil, and the second member may have a rod shape elongated in a direction of a winding axis of the second coil.

One end of the conductor pattern may be connected to one end of the first coil, another end of the conductor pattern may be connected to one end of the second coil, and another end of the first coil and another end of the second coil are connected to the matching network.

Other features and aspects will be apparent from the following detailed description, the drawings, and the claims.

BRIEF DESCRIPTION OF DRAWINGS

These and/or other aspects will become apparent and more readily appreciated from the following description of the embodiments, taken in conjunction with the accompanying drawings in which.

Figure 1:
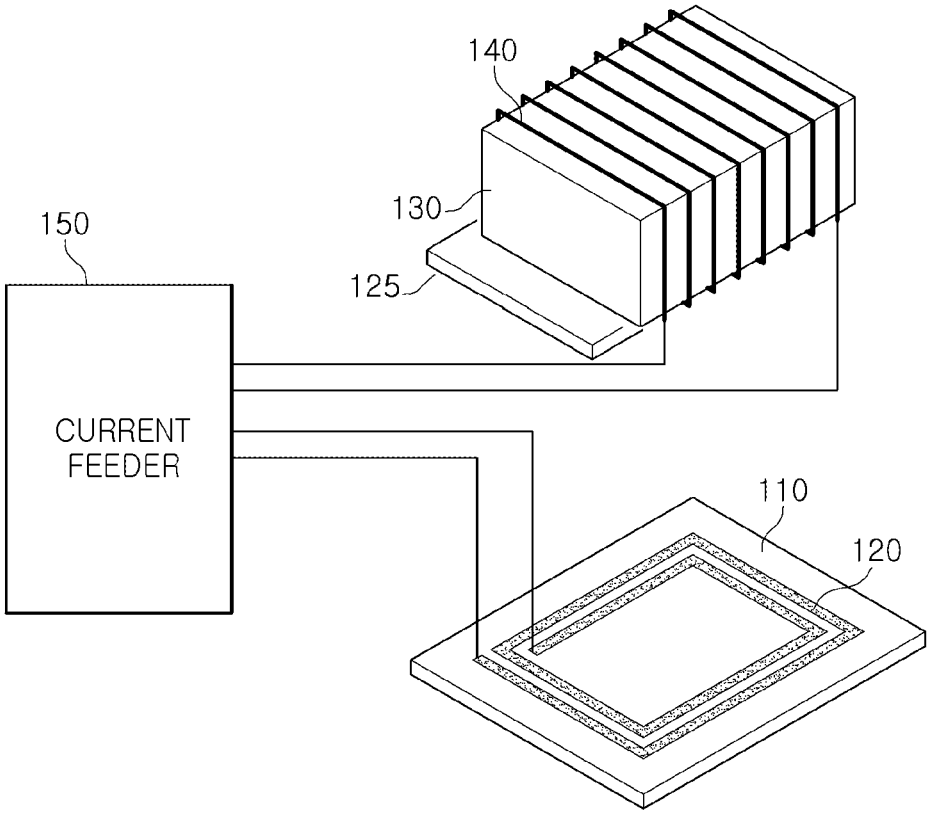
FIG. 1 is a diagram illustrating an antenna apparatus, according to an embodiment.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Hereinafter, reference will now be made in detail to examples with reference to the accompanying drawings, wherein like reference numerals refer to like elements throughout.

Various alterations and modifications may be made to the examples. Here, the examples are not construed as limited to the disclosure and should be understood to include all changes, equivalents, and replacements within the idea and the technical scope of the disclosure.

Although the terms "first," "second," "third," etc., may be used herein to describe various elements, components, regions, layers, and/or sections, these elements, components, regions, layers, and/or sections, should not be limited by these terms. These terms are only used to distinguish one element, component, region, layer, or section, from another region, layer, or section. Thus, a first element, component, region, layer, or section, discussed below may be termed a second element, component, region, layer, or section, without departing from the scope of this disclosure.

When an element is referred to as being "on," "connected to," "coupled to," or "adjacent to," another element, the element may be directly on, connected to, coupled to, or adjacent to, the other element, or one or more other intervening elements may be present.

The terminology used herein is for the purpose of describing particular examples only and is not to be limiting of the examples. As used herein, the singular forms "a", "an", and "the" are intended to include the plural forms as well, unless the context clearly indicates otherwise. It will be further understood that the terms "include/comprise" and/or "have" when used in this specification, specify the presence of stated features, integers, steps, operations, elements, components, and/or combinations thereof, but do not preclude the presence or addition of one or more other features, numbers, steps, operations, elements, components, and/or groups thereof.

Unless otherwise defined, all terms, including technical terms and scientific terms, used herein have the same meaning as how they are generally understood by those of ordinary skill in the art to which the present disclosure pertains. Any term that is defined in a general dictionary shall be construed to have the same meaning in the context of the relevant art, and, unless otherwise defined explicitly, shall not be interpreted to have an idealistic or excessively formalistic meaning.

Identical or corresponding elements will be given the same reference numerals, regardless of the figure number, and any redundant description of the identical or corresponding elements will not be repeated. Throughout the description of the present disclosure, when describing a certain relevant conventional technology is determined to evade the point of the present disclosure, the pertinent detailed description will be omitted. Terms such as "first" and "second" can be used in describing various elements, but the above elements shall not be restricted to the above terms. The above terms are used only to distinguish one element from the other. In the accompanying drawings, some elements may be exaggerated, omitted or briefly illustrated, and the dimensions of the elements do not necessarily reflect the actual dimensions of these elements.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

FIG. 1 is a diagram illustrating an antenna apparatus, according to an embodiment.

Referring to FIG. 1, an antenna apparatus, according to an embodiment, includes a first substrate 110, a conductor pattern 120, a second substrate 125, a member 130, a coil 140, and a current feeder 150.

The conductor pattern 120 is disposed on the first substrate 110. For example, in order to secure a winding radius of the conductor pattern 120 and improve a degree of layout freedom thereof, the first substrate 110 may be a flexible printed circuit board (FPCB) having relatively small width and low thickness.

The conductor pattern 120 is wound around a virtual line in a normal direction of one surface of the first substrate 110. As current flows in the conductor pattern 120, magnetic flux is formed in a normal direction. In accordance with an embodiment, the formation direction of the magnetic flux is a direction having a center of the conductor pattern 120 as a point of origin and a point having the strongest magnetic flux on a surface of a small virtual circle, the center of which is an arrival point.

The second substrate 125 is spaced apart from the first substrate 110. For example, a plurality of circuits for signal transmission and reception, of the antenna apparatus, according to an embodiment, are mounted on the second substrate 125. The circuits described above perform local area communications such as near field communications (NFC), magnetic secure transmissions (MST), wireless power transfer (WPT), and radio frequency identification (RFID), together with the antenna apparatus.

The second substrate 125 serves as a main substrate for local area communications. In an example, the first substrate 110 serves as a sub-substrate for the second substrate 125. That is, the first substrate 110 has a relatively large area to provide a layout space for the conductor pattern 120 which may be difficult to dispose on the second substrate 125.

The member 130 is mounted on the second substrate 125. Because the second substrate 125 is disposed to be spaced apart from the first substrate 110, the member 130 is spaced apart from the first substrate 110.

The coil 140 is wound around the member 130. As current flows in the coil 140, magnetic flux forms in a direction of a winding axis. Because the second substrate 125 is disposed to be spaced apart from the first substrate 110, the coil 140 is spaced apart from the conductor pattern 120.

In an example, the member 130 and the coil 140 form the magnetic flux in a region that is hardly or minimally affected by the conductor pattern 120. That is, the member 130 and the coil 140 are disposed in positions on the second substrate 125 in which the magnetic flux is hardly or minimally affected by the conductor pattern 120.

Likewise, the conductor pattern 120 or the coil 140 forms magnetic flux at a distance relative to amount of current flowing therein. Therefore, by disposing the conductor pattern 120 and the coil 140 to be spaced apart from each other, the magnetic flux that the coil 140 forms is in a region that is sufficiently or significantly spaced apart from the conductor pattern 120, even in a case in which a small amount of current flows through the coil 140. Accordingly, the antenna apparatus, according to an embodiment, may efficiently extend the formation region of the magnetic flux.

Further, properties of the magnetic flux formed by the coil 140 are different from properties of the magnetic flux formed by the conductor pattern 120. For example, a number of turns of the coil 140 may be greater than a number of turns of the conductor pattern 120. In an embodiment, a radius of the coil 140 is narrower than that of the conductor pattern 120. Accordingly, in a case in which the same amount current flows in the coil 140 and the conductor pattern 120, a region in which the magnetic flux is formed by the coil 140 may be narrower and longer than a region in which the magnetic flux is formed by the conductor pattern 120.

That is, properties of the region in which the magnetic flux is formed by the coil 140 may be different from that of the region in which the magnetic flux is formed by the conductor pattern 120. The antenna apparatus, according to an embodiment, includes the conductor pattern 120 and the coil 140 forming magnetic flux with different properties to efficiently extend the formation region of the magnetic flux.

By configuring the first substrate 110 and the member 130 to have different properties from each other, and to be spaced apart from each other, the formation region of the magnetic flux is largely extended. For example, by forming the magnetic flux in a region in which both the conductor pattern 120 and the coil 140 do not form the magnetic flux, the formation region of the magnetic flux is uniformly formed. The first substrate 110 is disposed to be adjacent to a region in which the magnetic flux is to be formed, such as a horizontal direction with respect to a width of the first substrate 110. The member 130 is disposed to be adjacent to a region in which the magnetic flux is to be formed, such as a longitudinal direction with respect to a length of the member 130. As a result, the formation region of the magnetic flux may be efficiently formed.

The current feeder 150 generates a current to the conductor pattern 120 and the coil 140. For example, a magnitude, a frequency, or a phase of the current generated from the current feeder 150 may be adjusted by the current feeder 150. The magnitude, the frequency, or the phase of the current corresponds to information that is transmitted and received by the antenna apparatus, according to an embodiment.

For example, the current feeder 150 controls the magnitude, the frequency, and the phase of the currents provided to the conductor pattern 120 and the coil 140 together using a multiple-input multiple-output (MIMO) concept.

In one illustrative configuration, the current feeder 150 is mounted on the second substrate 125 together with the member 130.

Figure 2:
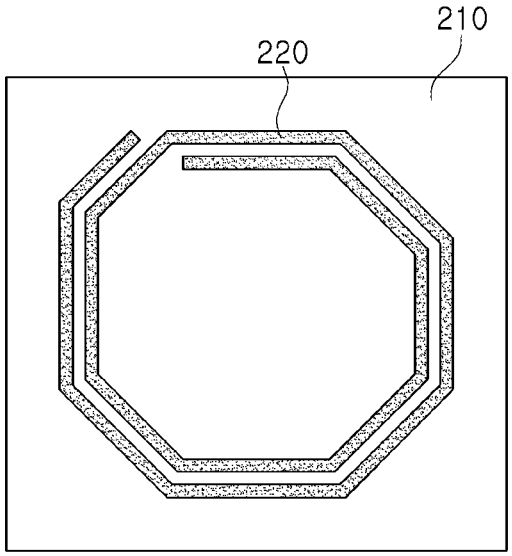
FIG. 2 is a diagram illustrating a first substrate and a conductor pattern of FIG. 1.

FIG. 2 is a diagram illustrating the first substrate 110 and the conductor pattern 120 of FIG. 1.

Referring to FIG. 2, a conductor pattern 220 is wound at an angle of 45° degrees on the first substrate 210. That is, the conductor pattern 220 is wound while forming an octangular shape. However, a person skilled in the relevant art will appreciate that the conductor pattern 220 may be wound forming other shapes, such as rectangular, heptagonal, or with more or less winding angles.

As winding angles of the conductor pattern 220 are small, such as less than 50° degrees, an amount of current required for the conductor pattern 220 to form magnetic flux having the same strength is reduced. Further, as the winding angle of the conductor pattern 220 is small, a formation level of difficulty and costs of the conductor pattern 220 is increased. Therefore, the conductor pattern 220 may be implemented in various shapes depending on a current consumption specification, the formation level of difficulty, and other factors.

For example, the first substrate 210 and the conductor pattern 220 have one wide surface and relatively low thickness. Therefore, the first substrate 210 may be disposed in a battery of the electronic device or may be mounted on a cover.

Figure 3:
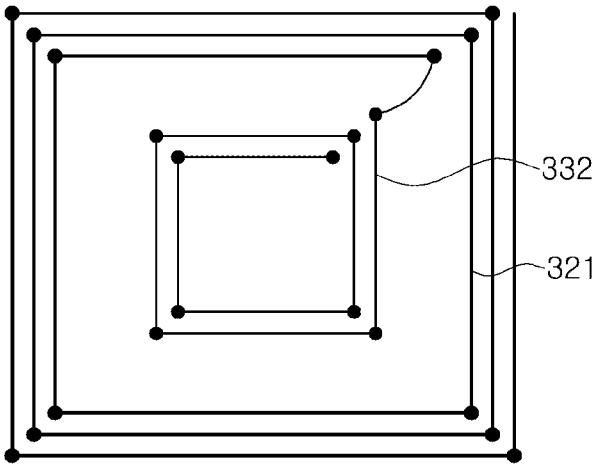
FIG. 3 is a diagram illustrating the conductor pattern of FIG. 1.

FIG. 3 is a diagram illustrating the conductor pattern 120 of FIG. 1.

Referring to FIG. 3, a conductor pattern 320 (the conductor pattern 120) includes a first conductor pattern 321 and a second conductor pattern 322.

The first conductor pattern 321 is wound to have a first winding radius. In an example, the winding radius is an average of the longest radius and the shortest radius of the conductor pattern.

The second conductor pattern 322 is connected to the first conductor pattern 321, and is wound to have a second winding radius, different from the first winding radius.

Depending on the winding radius of the conductor pattern, properties of the magnetic flux formed by the conductor pattern vary. Therefore, each of the first conductor pattern 321 and the second conductor pattern 322 may extend the entire formation region of the magnetic flux of the antenna apparatus by forming the magnetic flux in a region in which both the first conductor pattern 321 and the second conductor pattern 322 do not form the magnetic flux. That is, the magnetic flux of the first conductor pattern 321 and the second conductor pattern 322 do not overlap.

For example, the first and second conductor patterns 321 and 322 are implemented in a form in which a pattern, corresponding to an intermediate radius between the maximum radius and the minimum radius, is omitted. The pattern is in a form wound from the maximum radius of the first conductor pattern 321 to the minimum radius of the second conductor pattern 322.

Figure 4:
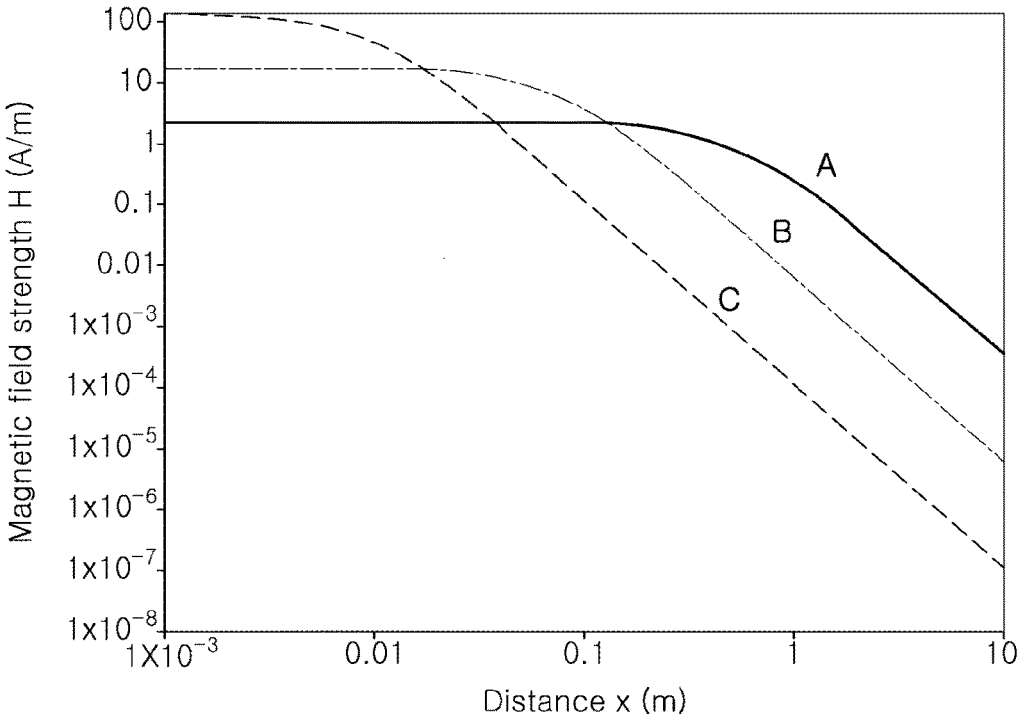
FIG. 4 is a graph illustrating a magnetic flux according to a winding radius of the conductor pattern of FIG. 3.

FIG. 4 is a diagram illustrating a magnetic flux, according to the winding radius of the conductor pattern of FIG. 3.

Referring to FIG. 4, line A represents properties of the magnetic flux formed by a conductor pattern having a long winding radius, line B represents properties of the magnetic flux formed by a conductor pattern having an intermediate winding radius, and line C represents properties of the magnetic flux formed by a conductor pattern having a short winding radius.

Strength of the magnetic flux in a region (a region in which x is small), adjacent to the conductor pattern is large as the winding radius of the conductor pattern is short. In addition, strength of the magnetic flux in a region (a region in which x is large), significantly spaced apart from the conductor pattern, may be large when the winding radius of the conductor pattern is wide.

That is, in a case in which the winding radius of the conductor pattern is small (line C), magnetic field strength may be large as a distance is close, and may significantly decrease as the distance is increased. On the other hand, in a case in which the winding radius of the conductor pattern is large (line A), the magnetic field strength is relatively small, compared to a case in which a coil radius is small when the distance is close. In the case in which the winding radius of the conductor pattern is large (line A), the decrease of the magnetic field strength is gradual or progressive compared to a decrease of the magnetic field strength of the coil radius being small, even when the distance is increased.

Because the antenna apparatus, according to an embodiment may include the conductor patterns and the coils having different winding radii, the magnetic field strength is strong at a short distance, thus, improving recognition performance for a communications target having a small size, and decreasing recognition performance deviation based on the size of the communications target.

Further, because the antenna apparatus, according to an embodiment includes conductor patterns having different winding radii, the magnetic flux may be more efficiently formed.

All of the lines A, B, and C represent strength of the magnetic flux in the case that that mutual-inductance is absent. Therefore, the conductor pattern and the coil included in the antenna apparatus, according to an embodiment, are spaced apart from each other so as to be hardly influenced by mutual-inductance.

For example, in a case in which a longest radius of the winding radius of the coil is smaller than a shortest radius of the winding radius of the conductor pattern, the coil and the conductor pattern are spaced apart from each other by a distance, which is greater than the longest radius of the coil.

Figure 5:
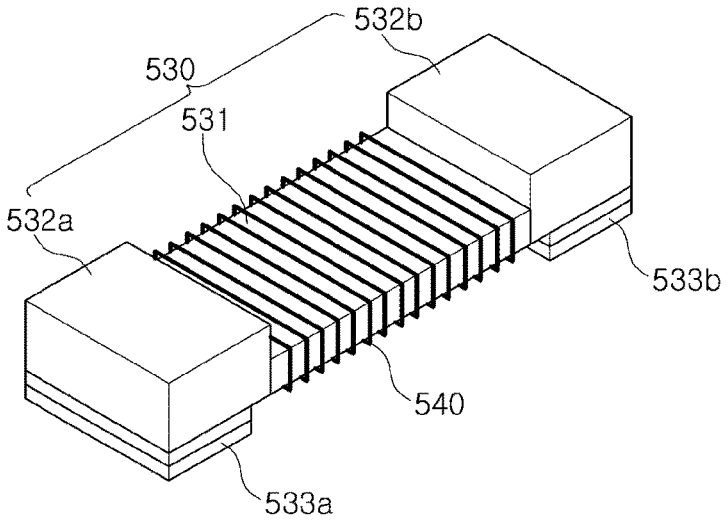
FIG. 5 is a diagram illustrating a first member and a coil of FIG. 1.

FIG. 5 is a diagram illustrating a first member and a coil of FIG. 1.

Referring to FIG. 5, a first member 530 includes a magnetic body 531, one or more protruding parts 532*a* and 532*b*, and one or more mounting surfaces 533*a* and 533*b*. An antenna including the first member 530 and a coil 540 may be defined as a chip antenna.

The magnetic body 531 has the coil 540 wound therearound and includes a magnetic material. For example, the magnetic material may be a ferrite, a material having a high degree of permeability. In addition, the magnetic body 531 may have an end surface having a quadrangular shape or a rectangular parallelepiped shape, so as to be mounted on a surface of the substrate and to implement miniaturization, and may also have an end surface having a circular shape or a polygonal shape. However, a person skilled in the art will appreciate that the end surfaces are not limited to the rectangular parallelepiped shape, the circular shape, or the polygonal shape. The end surfaces may have alternative shapes, while achieving the same result.

The one or more protruding parts 532*a* and 532*b* protrude in a direction of one surface of the magnetic body 531. A portion of the magnetic flux moves through the one or more protruding parts 532*a* and 532*b*. The one or more protruding parts 532*a* and 532*b* form a U shape, together with the magnetic body 531.

The one or more mounting surfaces 533*a* and 533*b* protrude from surfaces that are opposite to one or more surfaces on which the one or more protruding parts 532*a* and 532*b* are positioned in the magnetic body 531. The first member 530 may be surface-mounted mounted on the substrate, or the like using the one or more mounting surfaces 533*a* and 533*b*. For example, in a case in which the one or more mounting surfaces 533*a* and 533*b* protrude in a direction of the other surface of the magnetic body 531, the one or more mounting surfaces 533*a* and 533*b* form an H shape together with the one or more protruding parts 532*a* and 532*b* and the magnetic body 531.

Furthermore, the one or more mounting surfaces 533*a* and 533*b* also protrude in a direction perpendicular to the protruding direction of the one or more protruding parts 532*a* and 532*b*. Accordingly, the one or more protruding parts 532*a* and 532*b* also form a ⊂ or ⊃ shape together with the magnetic body 531.

Accordingly, the first member 530 provides a magnetic flux common path to significantly reduce eddy current loss, thereby efficiently forming the magnetic flux.

The coil 540 is wound around the magnetic body 531. In this case, a number of turns of the coil 540 is determined depending on a resonance frequency corresponding to a frequency band of a current flowing in the coil 540. In addition, the coil 540 is wound around the one or more protruding parts 532*a* and 532*b* as well as the magnetic body 531.

Hereinafter, an embodiment of a connection relationship and layout relationship of the antenna apparatus will be described with reference to FIGS. 6 through 11. Overlapped descriptions of contents the same as or corresponding to contents described above with reference to FIGS. 1 through 5 will be omitted. For example, because each of a second substrate on which a first member is mounted and a third substrate on which a second member is mounted is a configuration involved in the first member or the second member, the contents that make the point of a description of the connection relationship and the layout relationship unclear will be omitted.

Figure 6:
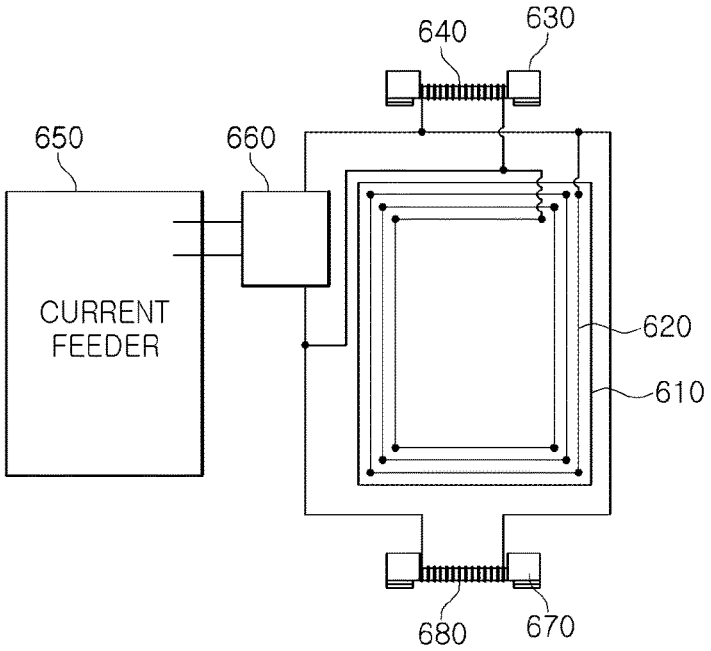
FIG. 6 is a diagram illustrating an antenna apparatus, according to an embodiment.

FIG. 6 is a diagram illustrating an antenna apparatus, according to an embodiment.

Referring to FIG. 6, an antenna apparatus, according to an embodiment, includes a first substrate 610, a conductor pattern 620, a first member 630, a first coil 640, a current feeder 650, a matching network 660, a second member 670, and a second coil 680.

One end of the conductor pattern 620 is connected to one end of the first coil 640, and another end of the conductor pattern 620 is connected to another end of the first coil 640. That is, the conductor pattern 620 and the first coil 640 are connected to the current feeder 650 in parallel. Accordingly, different currents may flow through the conductor pattern 620 and the first coil 640.

The matching network 660 matches impedance between the conductor pattern 620, the first coil 640, and the current feeder 650. Accordingly, loss of the current passing between the conductor pattern 620, the first coil 640, and the current feeder 650 is reduced.

The first member 630 is mounted on a second substrate and the second member 670 is mounted on a third substrate, different from the first substrate 610 and the second substrate. The second member 670 (first substrate) is spaced apart from the first substrate 610 and the first member 630 (second substrate). For example, the first substrate 610 is disposed between the first member 630 and the second member 670.

The second coil 680 is wound around the second member 670. The second coil 680 receives the current from the current feeder 650 to form the magnetic flux.

An antenna including the second member 670 and the second coil 680 is defined as a second chip antenna.

Furthermore, in one example, winding radii of the first coil 640 and the second coil 680 is smaller than winding radius of the conductor pattern 620. Further, the first coil 640 is spaced apart from the conductor pattern 620 by a distance greater than the winding radius of the first coil 640, and the second coil 680 is spaced apart from the conductor pattern 620 by a distance longer than the winding radius of the second coil 680.

Accordingly, each of the conductor pattern 620, the first coil 640, and the second coil 680 only slightly offsets the magnetic flux with mutual-inductance. Accordingly, the entire formation region of the magnetic flux of the antenna apparatus, according to an embodiment, is uniformly and efficiently formed.

Figure 7:
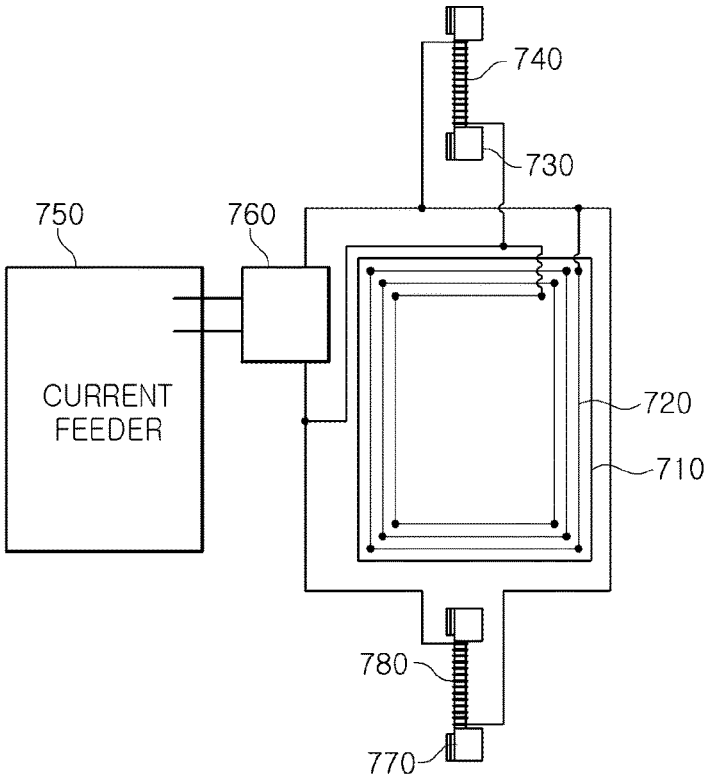
FIG. 7 is a diagram illustrating winding directions of a coil and a second coil of FIG. 6.

FIG. 7 is a diagram illustrating winding directions of the coil and the second coil of FIG. 6.

Referring to FIG. 7, an antenna apparatus, according to an embodiment, includes a first substrate 710, a conductor pattern 720, a first member 730, a first coil 740, a current feeder 750, a matching network 760, a second member 770, and a second coil 780.

Compared with the second and second members of FIG. 6, the second and second members 730 and 740 are disposed or positioned to be rotated in a winding direction corresponding to a direction of one surface of the first substrate 710. Accordingly, the antenna apparatus, according to an embodiment, are embedded in an electronic device having a narrow width and a long length.

Figure 8:
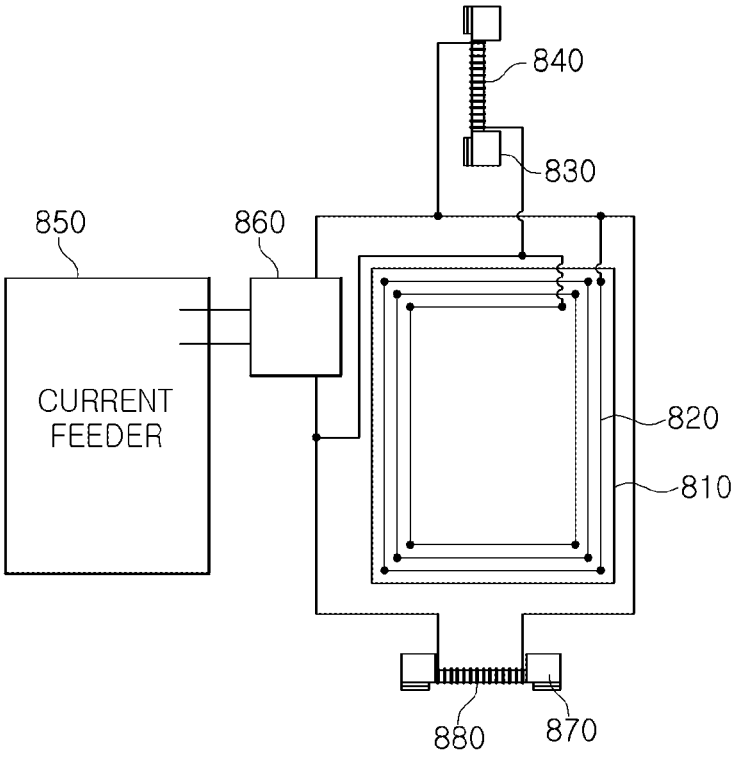
FIG. 8 is a diagram illustrating winding directions of a coil and the second coil of FIG. 6.

FIG. 8 is a diagram illustrating winding directions of the coil and the second coil of FIG. 6.

Referring to FIG. 8, an antenna apparatus, according to an embodiment, includes a first substrate 810, a conductor pattern 820, a first member 830, a first coil 840, a current feeder 850, a matching network 860, a second member 870, and a second coil 880.

The second coil 880 is wound in relation to a winding axis in a direction different from a direction of a winding axis of the first coil 840. Accordingly, the formation region of the magnetic flux is uniformly distributed in a direction perpendicular to a direction of one surface of the conductor pattern 820.

For example, a winding axis of the conductor pattern 820, the winding axis of the first coil 840, and a winding axis of the second coil 880 are perpendicular to one another. Accordingly, the formation region of the magnetic flux may be three-dimensionally and uniformly distributed.

Figure 9:
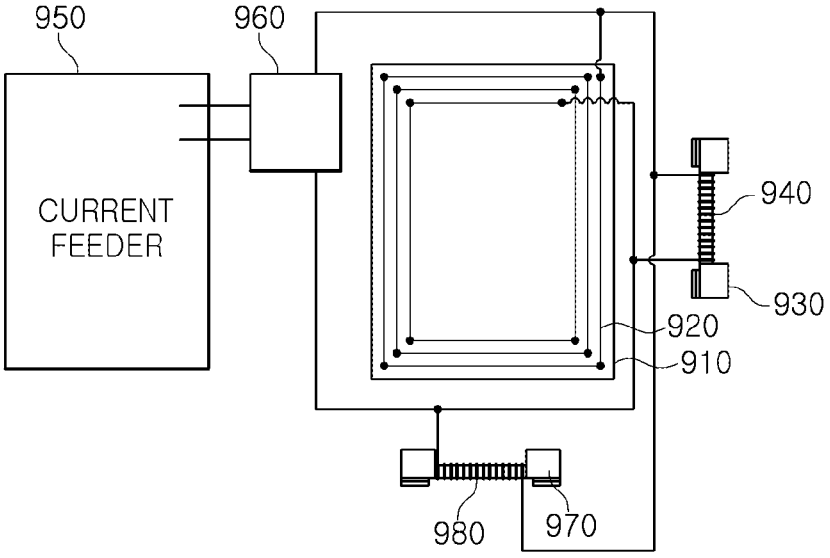
FIG. 9 is a diagram illustrating a layout of the second coil and second members of FIG. 6.

FIG. 9 is a diagram illustrating a layout of the second coil and second members of FIG. 6.

Referring to FIG. 9, an antenna apparatus, according to an embodiment, includes a first substrate 910, a conductor pattern 920, a first member 930, a coil 940, a current feeder 950, a matching network 960, a second member 970, and a second coil 980.

When viewed from a surface direction or normal direction of the first substrate 910, the first member 930 is disposed to a right or a side of the first substrate 910, and the second member 970 is disposed below the first substrate 910. That is, the first member 930 and the second member 970 are disposed on a plane perpendicular to the surface direction of the first substrate 910 to surround the first substrate 910.

For example, the first member 930 has a rod shape elongated in a direction of a winding axis of the coil 940, and the second member 970 has a rod shape elongated in a direction of a winding axis of the second coil 980. A size of the entire space occupied by the first, second, and second members 910, 930, and 970 may be reduced by the first member 930 and the second member 970 surrounding the first substrate 910.

In addition, the direction of the winding axis of the first coil 940 and the direction of the winding axis of the second coil 980 is different from each other. Accordingly, a region in which at least one of the coil 940 and the second coil 980 forms the magnetic flux is widened in a direction perpendicular to the surface direction of the first substrate 910. Because the conductor pattern 920 forms the magnetic flux in the surface direction or the normal direction, the conductor pattern 920, the first coil 940, and the second coil 980 may three-dimensionally and widely form the magnetic flux.

Accordingly, the antenna apparatus, according to an embodiment, may three-dimensionally extend a recognition region for a communications target.

In addition, the first member 930 and the second member 970 are mounted on the same substrate.

Figure 10:
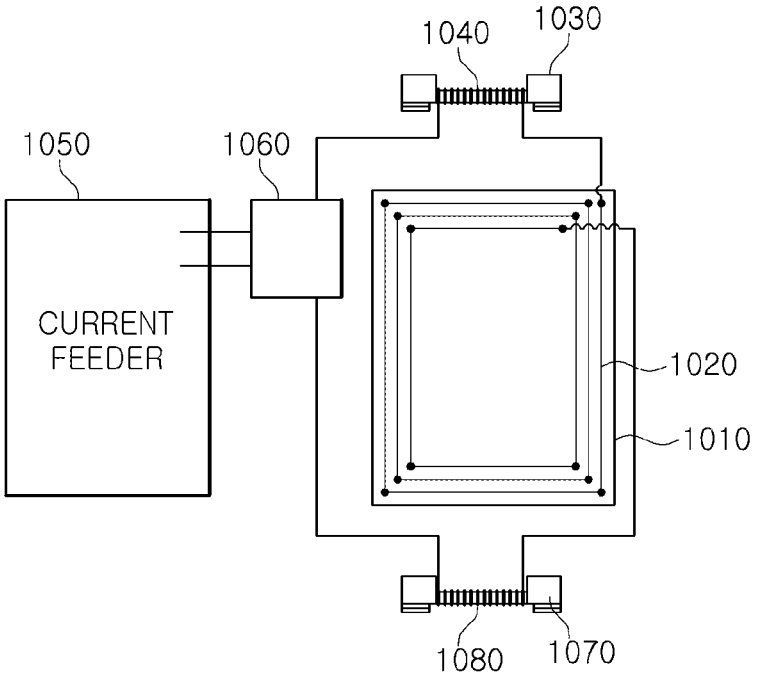
FIG. 10 is a diagram illustrating a connection relationship of the antenna apparatus of FIG. 6.

FIG. 10 is a diagram illustrating a connection relationship of the antenna apparatus of FIG. 6.

Referring to FIG. 10, an antenna apparatus, according to an embodiment, includes a first substrate 1010, a conductor pattern 1020, a first member 1030, a first coil 1040, a current feeder 1050, a matching network 1060, a second member 1070, and a second coil 1080.

One end of the conductor pattern 1020 is connected to one end of the first coil 1040. Another end of the conductor pattern 1020 is connected to one end of the second coil 1080. Another end of the first coil 1040 and the other end of the second coil 1080 are connected to the matching network 1060. That is, the first coil 1040, the conductor pattern 1020, and the second coil 1080 are electrically connected to each another in series.

Accordingly, the current feeder 1050 provides a single current to the first coil 1040 or the second coil 1080 using a minimal input and output terminal. In addition, the current feeder 1050 collectively adjusts the magnetic flux formed by the coil 1040, the conductor pattern 1020, and the second coil 1080.

Figure 11:
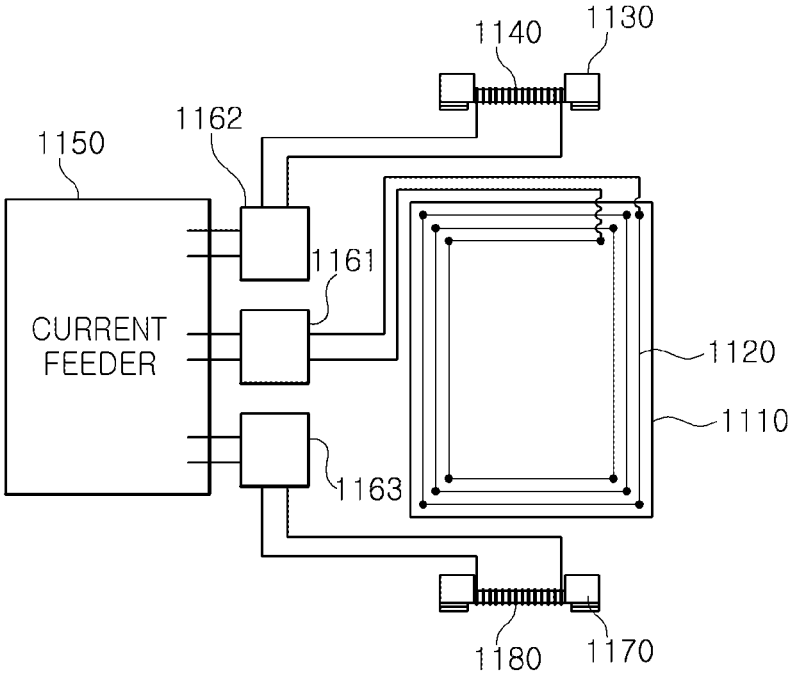
FIG. 11 is a diagram illustrating a connection relationship of the antenna apparatus of FIG. 6.

FIG. 11 is a diagram illustrating a connectional relationship of the antenna apparatus of FIG. 6.

Referring to FIG. 11, an antenna apparatus, according to an embodiment, includes a first substrate 1110, a conductor pattern 1120, a first member 1130, a first coil 1140, a current feeder 1150, a first matching network 1161, a second matching network 1162, a third matching network 1163, a second member 1170, and a second coil 1180.

The first matching network 1161 is connected to the conductor pattern 1120. The second matching network 1162 is connected to the coil 1140. The third matching network 1163 is connected to the second coil 1180. That is, the conductor pattern 1120, the coil 1140, and the second coil 1180 receive current independently from one another.

Accordingly, the current feeder 1150 adjusts each corresponding magnetic flux formed by the conductor pattern 1120, the coil 1140, and the second coil 1180. For example, the current feeder 1150 adjusts the current so that the magnetic flux is formed to be stronger in a specific direction than the magnetic flux in another direction. Accordingly, the current feeder 1150 reduces overall current consumption by efficiently controlling the current.

Figure 12:
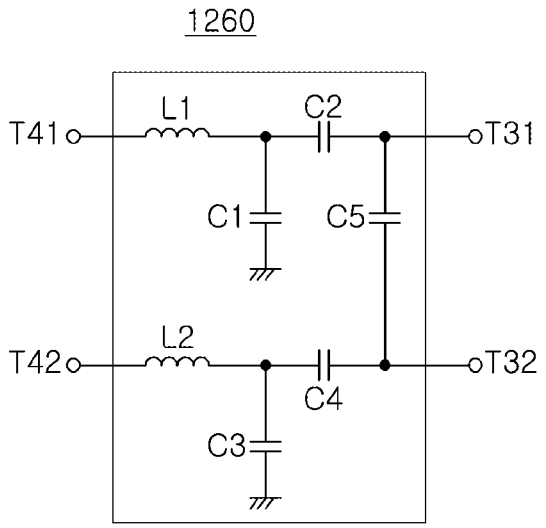
FIG. 12 is a diagram illustrating a matching network of FIG. 6.

FIG. 12 is a diagram illustrating a matching network of FIG. 6.

Referring to FIG. 12, a matching network 1260 includes first, second, third, fourth, and fifth capacitors C1, C2, C3, C4, and C5, and first and second inductors L1 and L2. In addition, the matching network 1260 is connected to the conductor pattern and/or the coil through first and second ports T31 and T32. In addition, the matching network 1260 is connected to the current feeder through third and fourth ports T41 and T42.

Each of the first and third capacitors C1 and C3 adjusts parasitic capacitance of a wire to a ground. Each of the second and fourth capacitors C2 and C4 break a DC current. The fifth capacitor C5 adjusts mutual-parasitic capacitance of the wire. Each of the first and second inductors L1 and L2 adjusts parasitic inductance of the wire. Accordingly, impedance of the wire is matched to specific impedance.

Further, in order to match impedance across the matching network, the matching network is re-configured depending or based on an impedance environment of a terminal or an electronic device, actually matches the impedance, and is not particularly limited to a specific impedance circuit.

Hereinafter, an electronic device, according to an embodiment, will be described with reference to FIGS. 13 through 15. Because the electronic device includes the antenna apparatus described with reference to FIGS. 1 through 12, an overlapped description the same as or corresponding to contents described above will be omitted.

Figure 13:
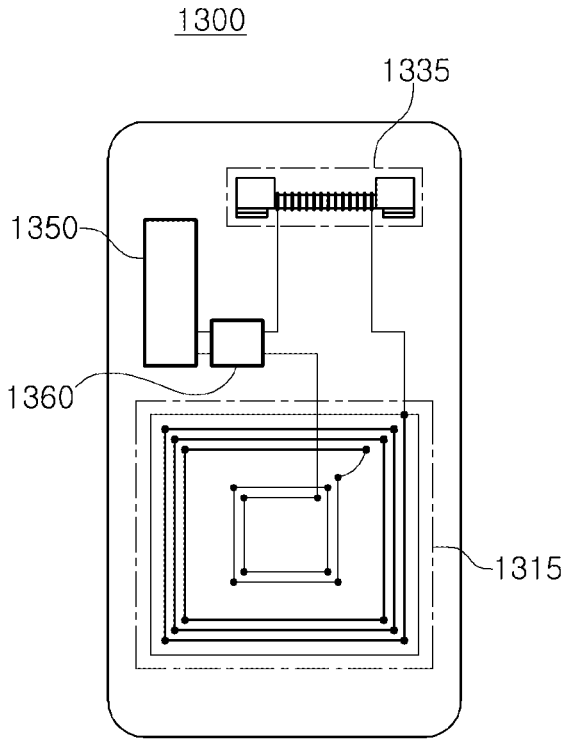
FIG. 13 is a diagram illustrating an electronic device, according to an embodiment.

FIG. 13 is a diagram illustrating an electronic device, according to an embodiment.

Referring to FIG. 13, an electronic device 1300, according to an embodiment, includes a first antenna unit 1315, a second antenna unit 1335, a current feeder 1350, and a matching network 1360.

The electronic device 1300, according to an embodiment, is not particularly limited as long as it is an apparatus that needs local area communications, including a telephone, such as a smartphone having a phone function, a video playback device, such as PMP configured to displaying video, a map guidance device, such as navigation system having a map guidance function, and other similar electronic devices.

The first antenna unit 1315 has a current flowing therein and forms the magnetic flux in one direction. For example, the first antenna unit 1315 includes loop antennas, which are wound in different winding radii.

The second antenna unit 1335 is spaced apart from the first antenna unit 1315, and has a current flowing therein to form the magnetic flux in a direction different to a formation direction of the magnetic flux of the first antenna unit 1315. That is, the second antenna unit 1335 sets the formation direction of the magnetic flux and is spaced apart from the first antenna unit 1315 so that a recognition region is formed in a region in which the recognition region for the communications target is not formed by the first antenna unit 1315.

Accordingly, the recognition region of the electronic device 1300 may be extended in multiple directions.

For example, the second antenna unit 1335 may be a different type of antenna from the first antenna unit 1315. In a case in which the first antenna unit 1315 is a loop antenna, the second antenna unit 1335 is a different type of antenna to the loop antenna, for instance, a chip antenna.

In a case in which the electronic device 1300 is a portable terminal, it may be difficult for an antenna that forms the magnetic flux to perform communications to implement signal transmission and reception in multiple directions due to an area limitation of the portable terminal. For example, the antenna that forms the magnetic flux to perform communications may be implemented by printing a loop pattern on a flexible printed circuit board (FPCB) and attaching a thin and flat antenna to a battery or a cover of a cellular phone. Accordingly, to secure performance, the antenna that forms the magnetic flux to perform communications may have a spatial limitation, such as being disposed in a region, separately and independent from an antenna emitting electromagnetic energy.

However, the first antenna unit 1315 included in the electronic device 1300, according to an embodiment, may be implemented as the loop antenna that utilizes a wide surface of the portable terminal to transmit and receive the signal through the wide surface. The second antenna unit 1335 may be implemented as an antenna that is adjacent to an edge of the portable terminal to transmit and receive the signal through a side surface of the portable terminal. Accordingly, the recognition region for the communications target of the electronic device 1300 is spatially and efficiently extended.

The current feeder 1350 provides a current to the first and second antenna units 1315 and 1335. For example, the current feeder 1350 provides a single current to the first and second antenna units 1315 and 1335. Accordingly, the current feeder 1350 collectively adjusts the magnetic flux formed by the first and second antenna units 1315 and 1335.

Figure 14:
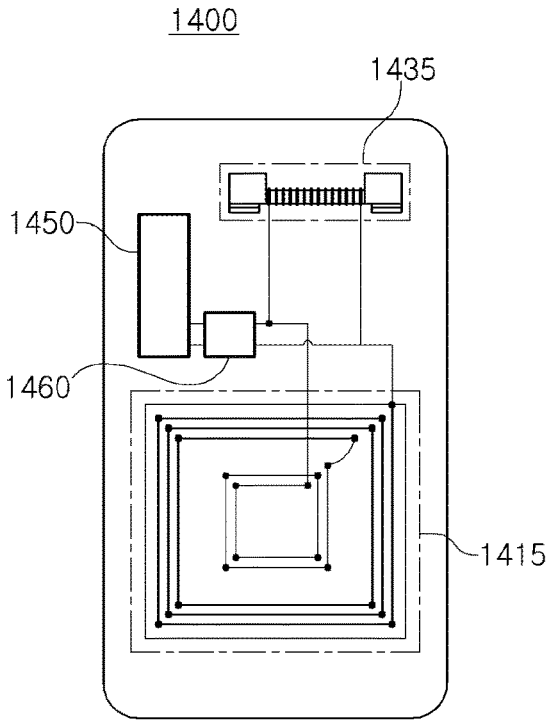
FIG. 14 is a diagram illustrating a connection relationship of the electronic device of FIG. 13.

FIG. 14 is a diagram illustrating a connection relationship of the electronic device of FIG. 13.

Referring to FIG. 14, an electronic device 1400, according to an embodiment includes a first antenna unit 1415, a second antenna unit 1435, a current feeder 1450, and a matching network 1460.

Each of the first antenna unit 1415 and the second antenna unit 1435 is connected in parallel to the matching network 1460. Accordingly, the current feeder 1450 collectively adjusts the magnetic flux formed by the first and second antenna units 1415 and 1435.

Figure 15:
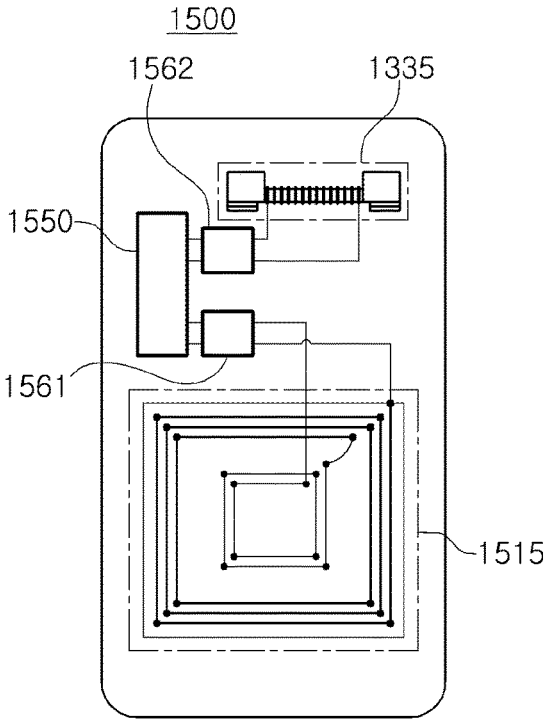
FIG. 15 is a diagram illustrating a connection relationship of the electronic device of FIG. 13.

FIG. 15 is a diagram illustrating a connection relationship of the electronic device of FIG. 13.

Referring to FIG. 15, an electronic device 1500, according to an embodiment, includes a first antenna unit 1515, a second antenna unit 1535, a current feeder 1550, a first matching network 1561, and a second matching network 1562.

The first matching network 1561 is connected to the first antenna unit 1515. The second matching network 1562 is connected to the second antenna unit 1535. That is, the first antenna unit 1515 and the second antenna unit 1535 receive a current independently from each other.

Accordingly, the respective magnetic flux formed by the first and second antenna units 1515 and 1535 are respectively adjusted by the current feeder 1550. For example, the current feeder 1550 adjusts the current so that the magnetic flux is formed to be stronger in a specific direction than that in another direction. Accordingly, the current feeder 1550 reduces overall current consumption by efficiently controlling the current.

Figure 16:
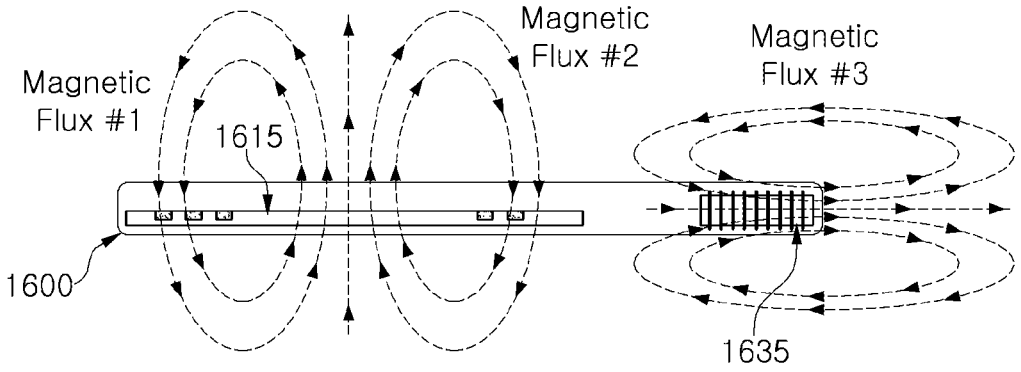
FIG. 16 is a diagram illustrating a magnetic flux formed by the electronic device of FIG. 13.

FIG. 16 is a diagram illustrating magnetic flux formed by the electronic device of FIG. 13.

Referring to FIG. 16, an electronic device 1600, according to an embodiment, forms a first magnetic flux (magnetic flux #1) and a second magnetic flux (magnetic flux #2) in a vertical direction, perpendicular, or normal direction to an upper surface of the electronic device 1600 using a first antenna unit 1615, and forms a third magnetic flux (magnetic flux #3) in a horizontal direction or in a parallel direction, at a distance from or without significantly interfering with the first and second magnetic fluxes (magnetic fluxes #1 and #2) using a second antenna unit 1635.

Accordingly, the antenna apparatus 1600, according to an embodiment, vertically and horizontally extends the recognition region for the communications target.

Figure 17A:
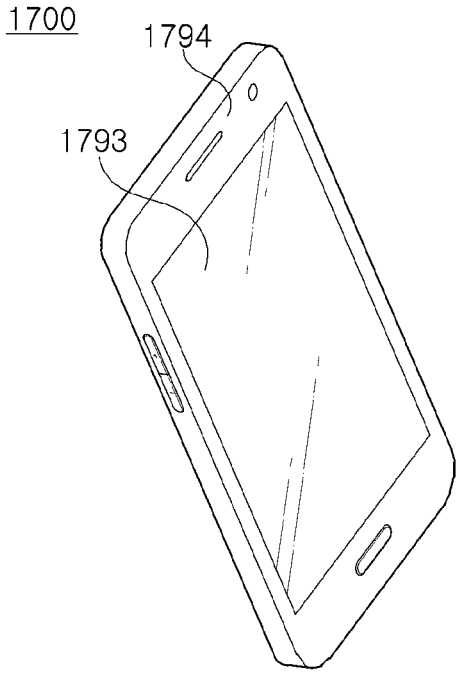
FIG. 17A is a perspective view of an electronic device, according to an embodiment.

FIG. 17A is a perspective view of an electronic device, according to an embodiment.

Figure 17B:
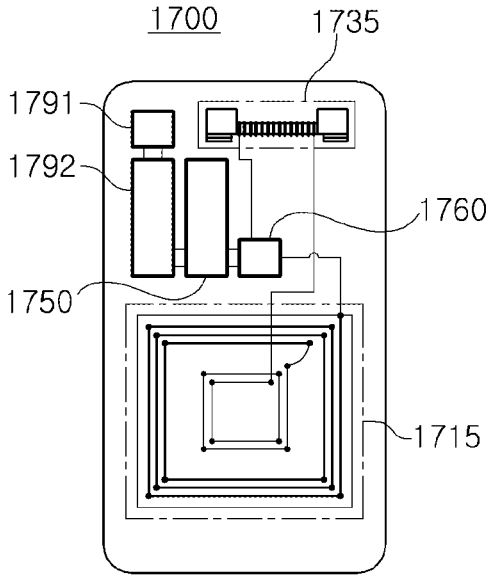
FIG. 17B is a diagram illustrating the electronic device, according to an embodiment.

FIG. 17B is a diagram illustrating an electronic device, according to an embodiment.

Referring to FIG. 17A and FIG. 17B, an electronic device 1700, according to an embodiment, includes a first antenna unit 1715, a second antenna unit 1735, a current feeder 1750, a matching network 1760, a state sensor 1791, a communications circuit 1792, a display panel 1793, and a housing 1794. Hereinafter, descriptions of contents the same as or corresponding to contents described above with reference to FIGS. 1 through 16 will be omitted.

The state sensor 1791 senses or detects a state between one direction and a gravity direction. For example, the state sensor 1791 senses a variation in gradient using a gyroscope sensor.

If the electronic device 1700 stands, the state sensor 1791 senses that a direction and a gravity direction are perpendicular to each other. Accordingly, the electronic device 1700 is configured to predict that a communications target thereof exists in a region spaced apart from the electronic device 1700 in the direction. Accordingly, the current feeder 1750 provides a high current to the first antenna unit 1715 and provides a low current to the second antenna unit 1735.

If the electronic device 1700 is inclined with respect to the gravity direction by 45°, the electronic device 1700 is configured to detect a variation in an existence position of the communications target thereof to be large. Accordingly, the current feeder 1750 uniformly provides the current to the first and second antenna units 1715 and 1735.

The communications circuit 1792 generates a communications signal and outputs the communications signal to the current feeder 1750. For example, the communications circuit 1792 includes at least one integrated circuit (IC) and passive elements, such as resistors, inductors, and capacitors, which process a digital or analog communications signal.

The display panel 1793 performs a display in a formation direction of magnetic flux of the first antenna unit 1715. In a case in which the first antenna unit 1715 is a loop antenna, the first antenna unit 1715 may have a hexahedral shape having a wide surface and a thin thickness. In addition, the display panel 1793 may be implemented in the hexahedral shape having one wide surface and the thin thickness in order to display a wide screen. Therefore, each of the first antenna unit 1715 and the display panel 1793 provide a space suitable for each other.

Also, the display panel 1793 may be implemented as a touch screen panel to provide an input function by a touch.

The housing 1794 covers a surface of the electronic device 1700 together with the display panel 1793, and accommodates the communications circuit 1792, the current feeder 1750, and the first and second antenna units 1715 and 1735.

Figure 18:
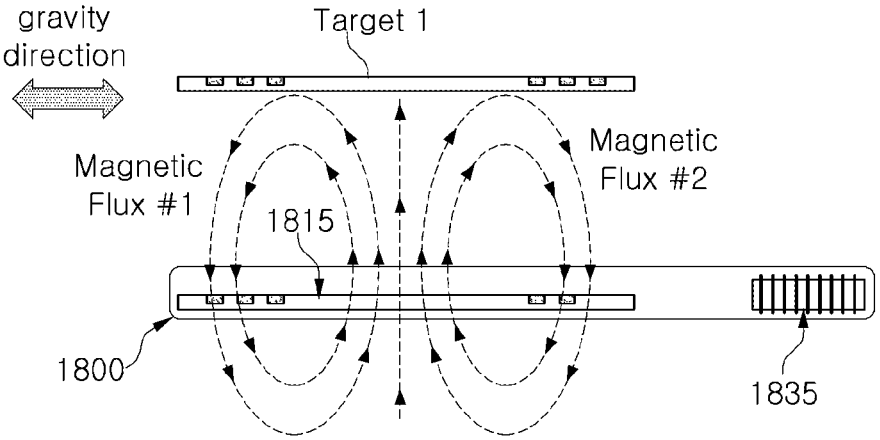
FIG. 18 is a diagram illustrating current control of the electronic device of FIG. 17A.

FIG. 18 is a diagram illustrating current control of the electronic device of FIG. 17A.

Referring to FIG. 18, an electronic device 1800, according to an embodiment, forms a first magnetic flux (magnetic flux #1) and a second magnetic flux (magnetic flux #2) in a vertical direction or a normal direction to an upper surface of the electronic device 1800 using a first antenna unit 1815 to perform communications for a communications target (target 1).

In an example, because the gravity direction is a horizontal direction or a parallel direction, it is assumed that the electronic device 1800 stands.

In a case in which the electronic device 1800 is inclined to be horizontal to the gravity direction (for instance, in a case in which a wide surface of a portable terminal is vertical to the gravity direction), the current feeder outputs a high current to the first antenna unit 1815 and provides a low current to a second antenna unit 1835. Accordingly, the recognition region for a normal direction of the electronic device 1800 is further extended. Further, as a low current flows through the second antenna unit 1835 or no current flows through the second antenna unit 1835, the impact of the second antenna unit 1835 on the first antenna unit 1815 is reduced. Accordingly, the first antenna unit 1815 efficiently transmits and receives the signal in a direction of a side surface of the electronic device 1800.

Further, the electronic device 1800 may also adjust the currents provided to the first and second antenna units 1815 and 1835 depending on a setting environment, without being influenced by the gravity direction.

In one example, if a user of the electronic device 1800 wants to extend the recognition region in along a direction of the side surface of the portable terminal, the electronic device 1800 is set to a first mode. Accordingly, the current feeder outputs a low current to the first antenna unit 1815 and outputs a high current to the second antenna unit 1835.

In addition, the electronic device 1800 adjusts magnitudes of the currents provided to the first and second antenna units 1815 and 1835 based on further state information, not the gravity direction. For example, the current feeder selects whether to use pins or to use a single pin by enabling or disabling a switch, such that current magnitudes provided to the first and second antenna units 1815 and 1835 are controlled. In an example, state information is state information determined by at least one of terminal attitude information, information on a direction in which the user grasps the electronic device, battery state information of the electronic device, and sensing information of an adjacent object, or a combination thereof.

Figure 19:
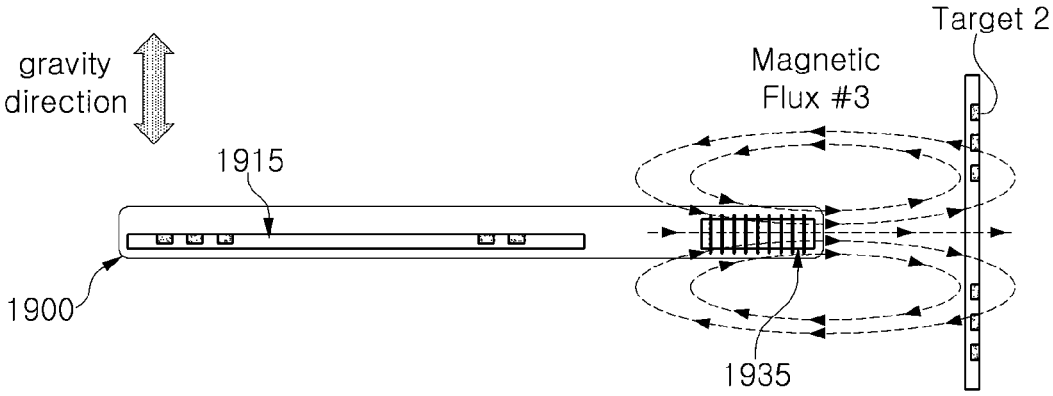
FIG. 19 is another diagram illustrating the current control of the electronic device of FIG. 17A.

FIG. 19 is a diagram illustrating current control of the electronic device of FIG. 17A.

Referring to FIG. 19, an electronic device 1900, according to an embodiment may form a third magnetic flux (magnetic flux #3) in a horizontal direction using a second antenna unit 1935 to perform communications for a communications target (target 2).

In an example, because the gravity direction is a vertical direction, the electronic device 1800 determines that it is inclined to be vertical to the gravity direction.

In a case in which the portable terminal is inclined to be vertical to the gravity direction (for instance, in a case in which a wide surface of the portable terminal is directed to the gravity direction), the current feeder outputs a low current to the first antenna unit 1915 and provides a high current to a second antenna unit 1935. Accordingly, the recognition region for a direction of a side surface of the electronic device 1900 is further extended. Further, as the low current flows in the first antenna unit 1915 or no current flows in the first antenna unit 1915, the impact of the first antenna unit 1915 on the second antenna unit 1935 is reduced. Accordingly, the second antenna unit 1935 efficiently transmits and receives the signal in a direction of a side surface of the portable terminal.

As described above, the electronic device 1900, according to an embodiment, controls the extension of the recognition region for the communications target through the current control. Accordingly, the recognition region of the electronic device 1900 is efficiently used, and current consumption of the electronic device 1900 is effectively reduced.

For instance, as magnitude of a current flowing through an antenna is large, a recognition region of the antenna may be generally extended. Therefore, in a case in which the antenna extends the recognition region to a region in which the recognition region does not need to be extended, current consumption of the antenna becomes inefficient.

However, because the electronic device 1900, according to an embodiment, outputs different currents to each of a plurality of antennas based on a setting or external sensing information, unnecessary current consumption and interference influence in each of the plurality of antennas is reduced. Accordingly, the current consumption in the electronic device 1900 is reduced.

The above-mentioned current control of the electronic device 1900 is illustrated as in the following Table 1.

TABLE 1

| Magnetic Flux Direction of First Antenna Unit | First Current | Second Current | Number of Used Pins |
|---|---|---|---|
| Vertical to Gravity Direction | Low current | High current | Plural |
| Horizontal to Gravity Direction | High current | Low current | Plural |
| Inclined with respect to Gravity Direction by 45° | Intermediate Current | Intermediate Current | Single |

As set forth above, according to various embodiments, the antenna apparatus extends the recognition region for the communications target in multiple directions and efficiently controls the recognition region to reduce current consumption.

Further, in the electronic device including the antenna apparatus, according to an embodiment, a degree of freedom of the layout of the antennas is increased, in which a recognition region offset between the antennas is reduced and the antennas are disposed or arranged so that the recognition regions are extended and are complemented by each other.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a first substrate;

a conductor pattern disposed on a surface of the first substrate and forming magnetic flux in a normal direction with respect to the surface of the first substrate;

a second substrate spaced apart from the first substrate;

a member disposed on the second substrate;

a coil wound around the member; and a current feeder configured to provide a first current to the conductor pattern and a second current to the coil, wherein the first current and the second current are determined by the current feeder based on a gravity direction determined by a sensor relative to an orientation information of the antenna apparatus.

2. The antenna apparatus of claim 1, wherein the member comprises:

a magnetic body comprising a magnetic material and having the coil wound around the magnetic material; and a protruding part protruding from one surface of the magnetic body and providing a mounting surface for the second substrate.

3. The antenna apparatus of claim 1, wherein a longest radius of a winding radius of the coil is shorter than a shortest radius of a winding radius of the conductor pattern, and the coil and the conductor pattern are spaced apart from each other by a distance, longer than a longest radius of the coil.

4. The antenna apparatus of claim 1, further comprising:

a matching network configured to match impedance among the conductor pattern, the coil, and the current feeder.

5. The antenna apparatus of claim 4, wherein one end of the conductor pattern is connected to the matching network, another end of the conductor pattern is connected to one end of the coil, and another end of the coil is connected to the matching network.

6. The antenna apparatus of claim 1, wherein one end of the conductor pattern is connected to one end of the coil, the other end of the conductor pattern is connected to another end of the coil, and the first current and the second current are independent of each other.

7. The antenna apparatus of claim 1, wherein the conductor pattern comprises:

a first conductor pattern comprising a first winding radius; and a second conductor pattern connected to the first conductor pattern and comprising a second winding radius, different from the first winding radius.

8. The antenna apparatus of claim 1, further comprising:

a third substrate spaced apart from the first substrate;

a second member disposed on the third substrate; and a second coil wound around the second member.

9. The antenna apparatus of claim 1, further comprising:

a second member spaced apart from the member and disposed on the second substrate; and a second coil wound around the second member, wherein a winding axis of the conductor pattern, a winding axis of the coil, and a winding axis of the second coil are perpendicular to one another.

10. The antenna apparatus of claim 1, wherein the first current and the second current are further determined based on either one or both of an altitude information and a sensing information of an adjacent object of the antenna apparatus.

11. An electronic device, comprising:

a communications circuit disposed on a substrate and configured to generate communications signals;

a battery spaced apart from the substrate and configured to supply power to the communications circuit;

a first antenna disposed on the battery and configured to form a first magnetic flux in one direction;

a second antenna disposed on the substrate and configured to form a second magnetic flux in a direction different to the one direction; and a current feeder disposed on the substrate, configured to receive the communications signals, provide a first current corresponding to one of the communications signals to the first antenna, and provide a second current corresponding to one of the communications signals to the second antenna, wherein the first current and the second current are determined by the current feeder based on a gravity direction determined by a sensor relative to an orientation information of the electronic device.

12. The electronic device of claim 11, wherein the first antenna comprises loop antennas wound in different winding radii.

13. The electronic device of claim 11, wherein the second antenna comprises chip antennas having different winding axis directions.

14. The electronic device of claim 11, wherein the second antenna comprises first and second chip antennas disposed to be opposite to each other in relation to the first antenna.

15. The electronic device of claim 11, wherein the second antenna comprises chip antennas disposed to surround the first antenna.

16. The electronic device of claim 11, wherein the current feeder determines magnitude of the first and second currents based on the state.

17. The electronic device of claim 11, further comprising:

a display panel configured to display in the one direction; and a housing configured to accommodate the communications circuit, the current feeder, and the first and second antennas together with the display panel.

18. An antenna apparatus, comprising:

a first substrate;

a conductor pattern disposed on the first substrate;

a second substrate spaced apart from the first substrate;

a member disposed on the second substrate; and a coil wound around the member, wherein a longest radius of a winding radius of the coil is smaller than a shortest radius of a winding radius of the conductor pattern, and the conductor pattern and the coil are spaced apart from each other by a distance greater than the longest radius of the winding radius of the coil, and wherein currents to the conductor pattern and the coil are determined by the current feeder based on a gravity direction determined by a sensor relative to an orientation information of the antenna apparatus.

19. The antenna apparatus of claim 18, further comprising:

a current feeder configured to provide a first current of the currents to the conductor pattern and a second current of the currents to the coil and configured to control a magnitude, a frequency, and a phase of the first and second currents.

20. The antenna apparatus of claim 18, wherein a magnetic flux formed by the coil is unaffected by a magnetic flux formed by the conductor pattern.

21. The antenna apparatus of claim 18, wherein a number of turns of the coil is greater than a number of turns of the conductor pattern.

22. The antenna apparatus of claim 18, wherein the first substrate is adjacently disposed in a region where a magnetic flux is formed by the conductor pattern.

23. The antenna apparatus of claim 18, wherein the member is adjacently disposed in a region in which a magnetic flux is formed by the coil.

24. The antenna apparatus of claim 18, wherein the conductor pattern comprises a first conductor pattern comprising a first winding radius being an average of a longest radius and the shortest radius of the winding radius of the conductor pattern, and a second conductor pattern connected to the first conductor pattern, and wound to have a second winding radius, different from the first winding radius.

25. The antenna apparatus of claim 24, wherein the first conductor pattern and the second conductor pattern each form a magnetic flux in a different region of the first substrate.

26. The antenna apparatus of claim 18, wherein the member comprises a magnetic body comprising an end surface having a quadrangular shape or a rectangular parallelepiped shape, a protruding part positioned on a surface of the magnetic body, and a mounting surface configured to protrude from a surface that is opposite to the surface on which the protruding part is positioned.

27. An antenna apparatus, comprises:

a first substrate;

a conductor pattern disposed on a surface of the first substrate;

a first member mounted on a second substrate, spaced apart from the first substrate;

a first coil wound around the first member;

a second member mounted on a third substrate, spaced apart from the first and second substrates; and a second coil wound around the second member, wherein the first substrate is disposed between the first member and the second member, and winding radii of the first coil and the second coil are smaller than a winding radius of the conductor pattern, and wherein a current to the second coil is determined by the current feeder based on a gravity direction determined by a sensor relative to an orientation information of the antenna apparatus.

28. The antenna apparatus of claim 27, further comprising:

a current feeder configured to generate the current to the second coil to form a magnetic flux, wherein the conductor pattern and the first coil are connected to the current feeder in parallel; and a matching network configured to match impedance between the conductor pattern, the first coil, and the current feeder.

29. The antenna apparatus of claim 28, wherein one end of the conductor pattern is connected to one end of the first coil, another end of the conductor pattern is connected to one end of the second coil, and another end of the first coil and another end of the second coil are connected to the matching network.

30. The antenna apparatus of claim 27, wherein one end of the conductor pattern is connected to one end of the first coil, and another end of the conductor pattern is connected to another end of the first coil.

31. The antenna apparatus of claim 27, wherein the first coil is spaced apart from the conductor pattern by a distance greater than a winding radius of the first coil, and the second coil is spaced apart from the conductor pattern by a distance longer than a winding radius of the second coil.

32. The antenna apparatus of claim 27, wherein a winding axis of the conductor pattern, a winding axis of the first coil, and a winding axis of the second coil are perpendicular to one another.

33. The antenna apparatus of claim 27, wherein the first member and the second member are disposed on a plane perpendicular to a surface direction of the first substrate to surround the first substrate.

34. The antenna apparatus of claim 27, wherein the first member has a rod shape elongated in a direction of a winding axis of the coil, and the second member has a rod shape elongated in a direction of a winding axis of the second coil.

* * * * *